United States Patent [19]

Morrison et al.

[11] 4,171,133

[45] Oct. 16, 1979

[54] SELF-PROPELLED TARGET TOY

[75] Inventors: Howard J. Morrison, Deerfield; Palmer J. Schoenfield, Evanston, both of Ill.

[73] Assignee: Marvin Glass & Associates, Chicago, Ill.

[21] Appl. No.: 876,402

[22] Filed: Feb. 10, 1978

[51] Int. Cl.[2] ..... A63B 71/02

[52] U.S. Cl. ..... 273/127 C; 46/103

[58] Field of Search ..... 273/102 R, 127 R, 127 C, 273/102 AP, 102.1 R, 102.1 C; 124/36, 37; 46/103, 202, 265, 266, 264, 206, 141, 104, 252

[56] References Cited

U.S. PATENT DOCUMENTS

| | | | |
|---|---|---|---|
| 294,076 | 2/1884 | Reed | 273/102.1 C |
| 1,893,121 | 1/1933 | Alger | 46/103 |
| 2,306,898 | 12/1942 | Palmer | 273/102.1 C |
| 3,132,864 | 5/1964 | Glass et al. | 273/127 C |
| 3,172,665 | 3/1965 | Glass et al. | 273/127 R |
| 3,191,343 | 6/1965 | Goldfarb | 46/103 |

*Primary Examiner*—Richard C. Pinkham
*Assistant Examiner*—T. Brown
*Attorney, Agent, or Firm*—Mason, Kolehmainen, Rathburn & Wyss

[57] ABSTRACT

A self-propelled wheeled toy includes a housing defining an external body portion and an internal chamber. A spring-type drive motor is mounted in the internal chamber and drivingly connected to the wheels. The motor is cocked by a manually actuatable lever pivotally mounted within the chamber and extends through a slot. A projectile capturing member is pivotally mounted on the housing to provide a target for a projectile directed toward the toy. Once an object is captured, the projectile capturing member pivots due to the weight of the object and engages a switch actuating the motor and causing the toy to move across a suitable supporting surface. As the motor operates, the lever is rotated and engages the capturing member causing the member to pivot and discharge the object.

9 Claims, 6 Drawing Figures

SELF-PROPELLED TARGET TOY

BACKGROUND OF THE INVENTION

1. Field of the Invention

The present invention relates to self-propelled target toys which are energized to move across a surface upon receipt of a projectile.

2. Brief Description of the Prior Art

Target toys and games have been known for many years and have included targets which have either been stationary, releasable for travel, movably displaceable in one direction or have been capable of being halted from travel as a result of striking of an object against a target area. Typically, self-propelled target toys have been of the type that are propelled until engaged by an object at a target location. In addition, the typical prior art self-propelled target toy does not include the capability of returning the object thrown. Various prior art devices are shown in U.S. Pat. Nos. 3,191,343; 3,172,665 and 3,132,864.

SUMMARY OF THE INVENTION

Accordingly, the general object of the present invention is the provision of a novel target toy.

A further object of the present invention is to provide a target toy that is propelled when an object is rolled or tossed into the toy.

Another object of the present invention is to provide a new and novel wheeled toy that returns an object thrown at it after the toy moves a distance across a surface.

The present invention is directed to a new and improved self-propelled target toy or wheeled toy including a housing in the shape and form of a body of an animal or other fanciful creature such as a dog. The body includes an opening that corresponds to the mouth of the creature and a set of wheels to allow the toy to move across a surface. A self-contained spring operated motor is drivingly connected to the wheels to propel the toy across a surface. A crank or winding lever is connected to the motor to apply tension to or wind the spring.

A projectile capturing member is pivotally mounted within the opening and is moved upon engagement with a thrown object to a position which actuates the motor to propel the toy a predetermined distance across the surface. As the toy is propelled, the crank is rotated until it engages the pivoted projectile capturing member causing the member to return to its original position. As this occurs, the object rolls out of the capturing member in the direction from which it was thrown. Upon disengagement of the pivoted member from the motor, the motor is again stopped halting the movement of the toy across the surface.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DESCRIPTION OF THE PREFERRED EMBODIMENT

Figure 1:
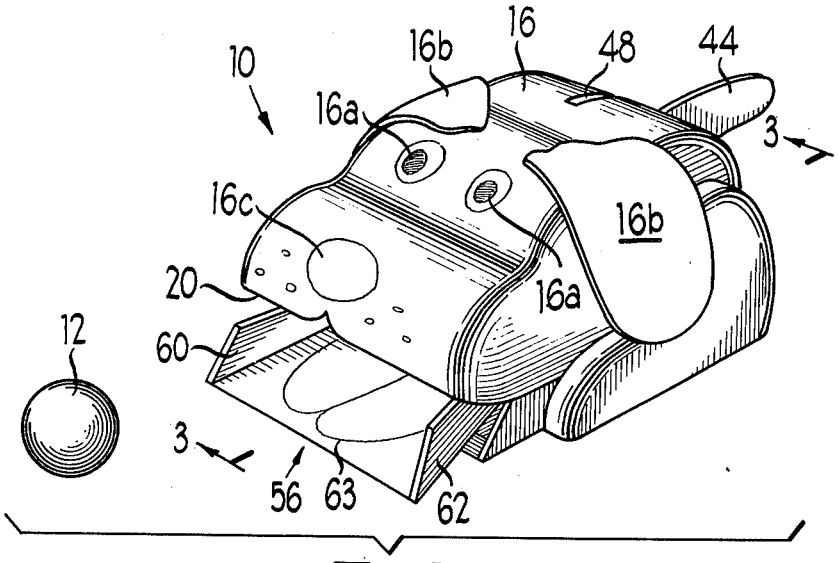
FIG. 1 is a perspective view of a self-propelled target toy constructed in accordance with the principles of the present invention.
Figure 2:
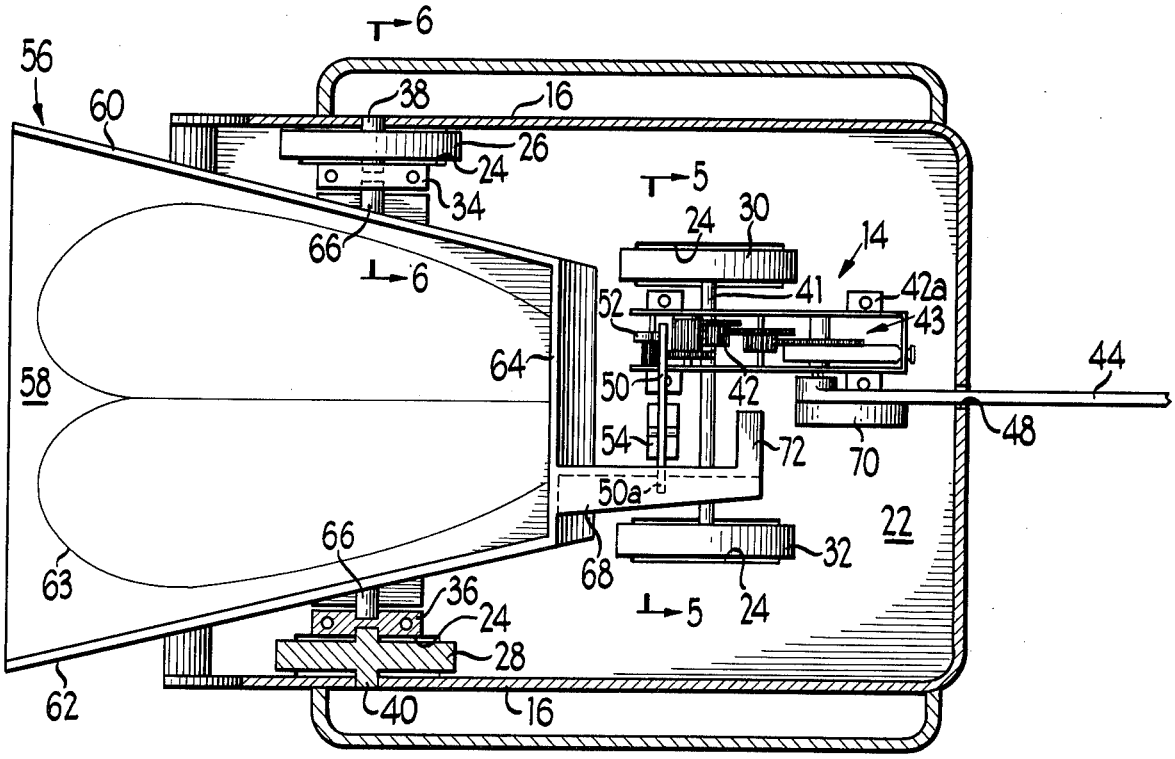
FIG. 2 is a horizontal cross-sectional view of the toy of FIG. 1.

With reference now to the drawings and initially to FIG. 1, there is illustrated a self-propelled wheeled toy or target toy generally designated by the reference numeral 10. The toy 10 is intended to capture an object, such as a ball 12 that is thrown or rolled at the toy 10. Once the ball 12 is captured, a self-contained motor 14 (FIG. 2) propels the toy 10 across a surface. At the completion of the travel of the toy 10, the ball 12 is released from the toy 10 in the direction of the player who threw the ball 12.

More particularly, the toy 10 includes a housing 16 that may be of plastic or similar material molded in the configuration of a fanciful creature, such as, in a preferred embodiment, a dog having a pair of eyes **16*a* and ears 16*b*, a nose 16*c* and a tail. The housing or body 16 defines an internal chamber or cavity 18 including an opening 20 at one end corresponding to the mouth of the dog. The housing 16 includes a base or bottom wall 22 with slots 24 through which one or more wheels 26, 28, 30 and 32 may extend thus providing support to the body 16 and allowing the toy 10 to be moved along a surface. The base 22 of the housing 16 includes internal vertical flanges 34 and 36 and the front wheels 26 and 28 include integral axles 38 and 40 that extend through an aperture in the body 16 and the respective flanges 34 and 36 to mount the wheels 26 and 28 on the body 16** for rotational movement.

The rear wheels 30 and 32 are mounted on an axle 41 (FIG. 2) extending through the motor 14 and connected to one of the gears 42 in the gear train 43, such that the wheels 30 and 32 are rotated by the motor 14. The motor 14 is of a type well known in the art which is mounted by a plurality of riser blocks **42*a*. The motor spring 43*a* is connected to a square shaft 45 which is cocked by a manually depressing lever or crank 44 which, in the preferred embodiment, is in the configuration of the tail of the dog. The tail extends from the shaft 45 on the motor 14 through a slot 48 in the body 16. The user of the toy 10 may move the tail or crank 44 downward to the position illustrated in FIGS. 1 and 3 thus cocking the motor 14**.

Figure 5:
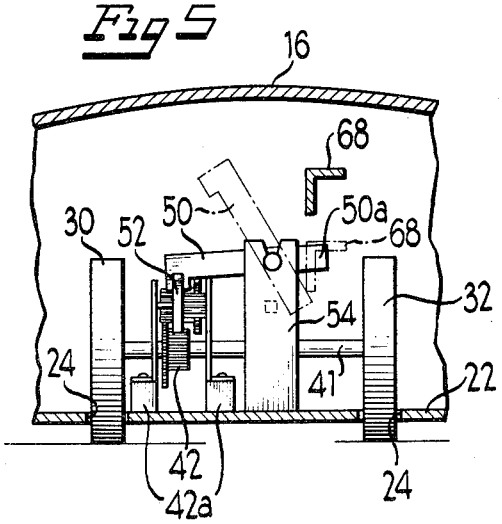
FIG. 5 is a fragmented vertical sectional view taken generally along line 5—5 of FIG. 2.
Figure 6:
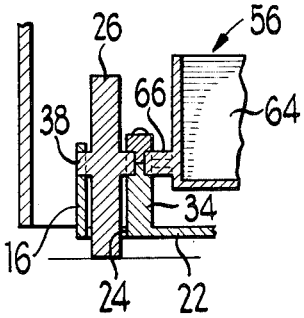
FIG. 6 is a fragmented vertical sectional view taken generally along line 6—6 of FIG. 2.

Once the motor is cocked, however, it will not operate since it is latched in an inoperative mode by a latch or bar 50. In its lowered position, the latch 50 engages a rectangular flywheel 52 connected by a pinion gear to the gear train of the motor 14 thus preventing operation. The lever 50 is pivotally mounted within a support 54 (FIG. 5) that is secured to the base 22. The opposite end **50*a* of the lever 50 extends outwardly away from the support 52 in an opposite direction such that upon contact of end 50*a*, the lever 50 is pivoted about the support 54 releasing the flywheel 52 and allowing the motor 14 to operate to propel the toy 10**.

Pivoting of the latch 50 is accomplished by engagement with a projectile capturing member generally designated by the reference numeral 56. The projectile capturing member 56, in the preferred embodiment, is in the configuration of a scoop or open funnel having a bottom portion 58 and sides 60 and 62. The scoop is decorated with indicia representative of a tongue 63 to add realism to the toy. The sides 60 and 62 are flared or converge from the front of the toy toward the back wall 64 of the capturing member 56. The projectile capturing member 56 is mounted by an axle 66 secured at opposite ends in the supports 34 and 36 so as to be coaxial with the axles 38 and 40 of the wheels 26 and 24, respectively. In the normal position, the projectile capturing member 56 is pivoted by its weight to a position such that the open or front end of the member 56 abuts the support surface on which the toy 10 is resting (see FIGS. 1 and 3). In this position, an object such as the ball 12 may be rolled into the opening 20 onto the projectile capturing member 56. As the ball 12 moves up the bottom surface 58 of the capturing member 56 and rolls beyond the axle 66, the capturing member 56 is pivoted by the weight of the ball to the position illustrated in FIG. 4.

The projectile capturing member 56 includes an arm 68 that extends away from the back wall 64 toward the motor 14. This arm 68 engages the latch 50 as the projectile capturing member 56 is pivoted to the position illustrated in FIG. 4, pivoting the latch 50 upwardly to the position illustrated in phantom lines in FIG. 5. This action releases the flywheel 52 and allows the motor 14 to propel the toy 10 forwardly across the surface. As the motor 14 is operating, the shaft 45 causes the crank 44 to rotate upwardly from the position illustrated in FIG. 3 to the position illustrated in FIG. 4 (arrow A).

Figure 3:
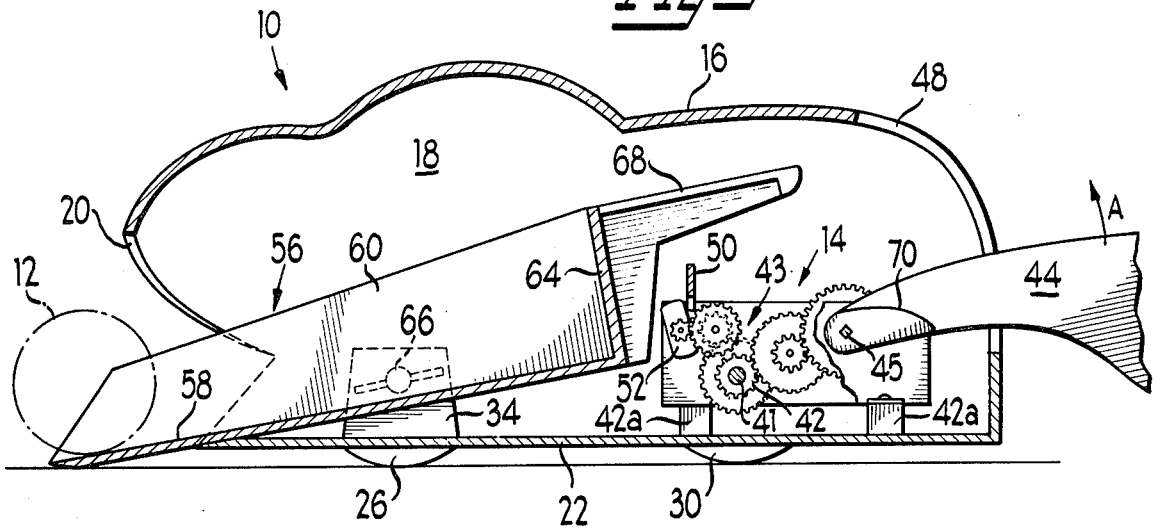
FIG. 3 is a vertical sectional view taken generally along line 3—3 of FIG. 1.
Figure 4:
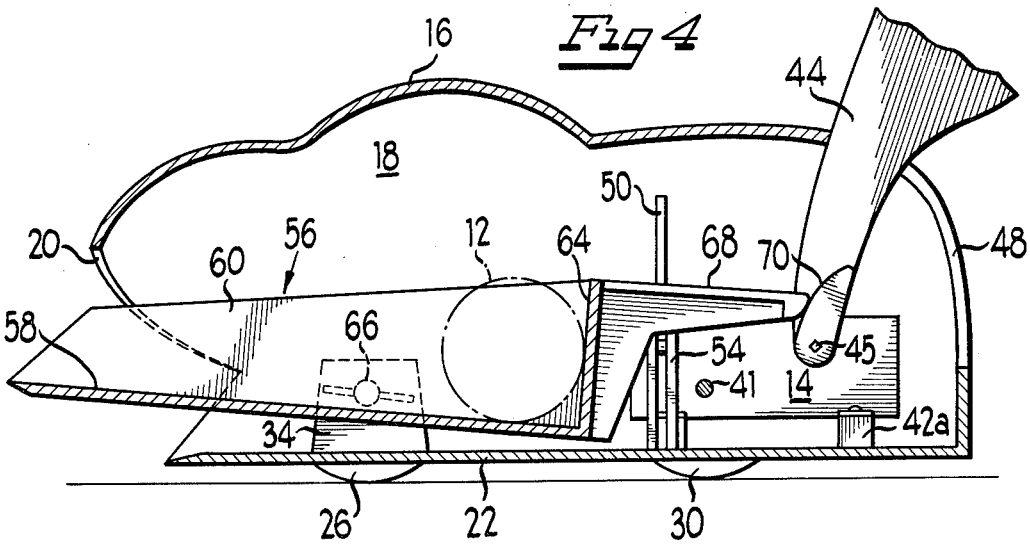
FIG. 4 is a view similar to FIG. 3 with a thrown object captured within the toy.

The crank 44 includes an embossed cam surface 70 at its pivoted end that engages a leg or extension 72 (FIG. 2) of the arm 68 causing the projectile capturing member 56 to pivot about its axle 66 to the original position (FIG. 3). As this occurs, the ball 12 will be ejected by the projectile capturing member 56 and roll out of the toy 10 permitting the projectile capturing member 56 to return to, and remain in, its initial position illustrated in FIGS. 1 and 3. At the same time, the latch 50 again pivots about the support 54 to engage the flywheel 52 thus terminating the operation of the motor 14 and the movement of the toy 10.

The operation of the toy 10 is such that once an object is rolled or thrown onto the projectile capturing member 56, the projectile capturing member 56 is pivoted to engage the latch 50, thus causing the toy 10 to be propelled across a surface. At the conclusion of the movement of the toy 10 across the surface, the capturing member 56 is pivoted in the opposite direction thus ejecting the ball 12 and returning it in the general direction from which it was thrown or rolled. To repeat the cycle, the spring motor 14 is cocked by manual movement of the tail 44, which prepares the unit for another movement.

Many modifications and variations of the present invention are possible in light of the above teachings. Thus, it is to be understood that, within the scope of the appended claims, the invention may be practiced other than as specifically described above.

We claim:

1. A target toy, comprising:

a supporting frame;

drive means on said frame for propelling the toy over a suitable support surface;

projectile receiving means defined on said frame for actuating said drive means in response to a projectile engaging said receiving means; and propelling means mounted on said frame for ejecting a projectile from said receiving means after a predetermined period of actuation of said drive means.

2. The target toy of claim 1 wherein said drive means includes a spring motor and crank means connected thereto for manually winding said spring motor.

3. The target toy of claim 2 wherein said frame is in the form and shape of a dog and said crank corresponds to a simulated tail for the dog.

4. The target toy of claim 1 wherein said receiving means includes a latch for maintaining said drive means in an inoperative position and a receiver for moving said latch to allow operation of said drive means upon receipt of a projectile, said receiver comprises a projectile capturing member pivotally mounted on the frame for movement from a preset position to an actuating position for disengaging said latch in response to the weight of a projectile received by said receiver.

5. The target toy of claim 4 wherein said receiver includes cam means operated by said drive means to move the receiver from said actuating position to said preset position to thereby eject the projectile.

6. A self-propelled target type toy for capturing and returning projectiles, comprising:

a housing including an opening defined therein;

wheel means for supporting said housing for movement and drive means for propelling said housing over a suitable supporting surface;

projectile capturing means for receiving and projecting projectiles;

latch means for releasably latching said drive means, said latch means being controlled in part by said projectile capturing means for releasing said drive means upon capturing a projectile; and means associated with said drive means for actuating said projectile capturing means to eject a captured projectile.

7. A self-propelled target toy for capturing a projectile moving across a surface and returning said projectile, comprising:

a housing;

means for moving said target toy across a suitable supporting surface; and a projectile capturing member pivotally mounted on said housing, said capturing member being adapted to pivot between a first position for receipt of a projectile and a second position for capturing said projectile, said capturing means including an actuator for actuating said drive means when said capturing member is in said second position and means for pivoting said projectile capturing member from said second position to said first position to deactivate said means for moving and project the projectile.

8. The target toy of claim 7 wherein said toy is in the shape and form of a dog and said projectile receiving means generally comprises the mouth of the dog.

9. A self-propelled target toy for capturing a projectile and returning the projectile, comprising:

a housing formed generally in the shape of an animal;

drive means on the housing for propelling the target toy over a suitable supporting surface, said drive means including a spring motor and crank means connected thereto for manually winding said spring motor, said crank corresponding to a simulated tail for the animal;

projectile receiving means defined on said housing for actuating said drive means in response to receipt of a projectile, said projectile receiving means comprising a projectile capturing member pivotally mounted on the housing for movement from a preset projectile receiving position to an actuating position in response to the weight of the projectile; and propelling means mounted on the housing for ejecting the projectile from the capturing member by pivotal movement thereof after a predetermined period of actuation of said drive means.

* * * * *